US010080701B1

(12) United States Patent
Bagheri

(10) Patent No.: US 10,080,701 B1
(45) Date of Patent: Sep. 25, 2018

(54) WALKER

(71) Applicant: Kourosh Bagheri, Shell Beach, CA (US)

(72) Inventor: Kourosh Bagheri, Shell Beach, CA (US)

( * ) Notice: Subject to any disclaimer, the term of this patent is extended or adjusted under 35 U.S.C. 154(b) by 0 days.

(21) Appl. No.: 15/834,507

(22) Filed: Dec. 7, 2017

Related U.S. Application Data

(63) Continuation-in-part of application No. 15/712,129, filed on Sep. 21, 2017, which is a continuation-in-part of application No. 15/218,052, filed on Jul. 24, 2016, now abandoned, which is a continuation of application No. 15/013,000, filed on Feb. 2, 2016, now Pat. No. 9,414,987, which is a continuation-in-part of application No. 14/617,872, (Continued)

(51) Int. Cl.

| | |
|---|---|
| ***A61H 3/04*** | (2006.01) |
| ***A61H 3/00*** | (2006.01) |
| *A61G 5/10* | (2006.01) |

(52) U.S. Cl.

CPC ..... *A61H 3/04* (2013.01); *A61H 3/008* (2013.01); *A61G 5/1059* (2013.01); *A61H 2003/043* (2013.01); *A61H 2201/0103* (2013.01); *A61H 2201/0161* (2013.01); *A61H 2201/0173* (2013.01); *A61H 2201/0192* (2013.01); *A61H 2201/1207* (2013.01); *A61H 2201/1238* (2013.01); *A61H 2201/1481* (2013.01); *A61H 2201/1633* (2013.01); *A61H 2201/1652* (2013.01); *A61H 2201/501* (2013.01); *A61H 2201/5023* (2013.01); *A61H 2201/5043* (2013.01); *A61H 2201/5056* (2013.01); *A61H 2201/5058* (2013.01); *A61H 2201/5084* (2013.01); *A61H 2201/5092* (2013.01); *A61H 2201/5097* (2013.01)

(58) Field of Classification Search

CPC ..... A61H 2003/043–2003/046; A61H 3/04

See application file for complete search history.

(56) References Cited

U.S. PATENT DOCUMENTS 2,020,766 A * 11/1935 Brown ..... B62B 3/106 220/9.3

2,645,538 A * 7/1953 Segal ..... A47B 9/00 108/145

(Continued)

*Primary Examiner* — Erez Gurari

(74) *Attorney, Agent, or Firm* — Quickpatents, LLC; Kevin Prince

(57) ABSTRACT

A walker is disclosed providing motorized height adjustment and having U-shaped lower and upper frames, each with left and right members. Both the left and right lower and upper member front ends mutually connect. Both frames are horizontally oriented, with the upper frame generally above the lower frame, which includes wheels. Generally vertical left and right double scissor mechanisms interposed between the upper and lower members maintain the alignment of the upper and lower frames. At least one powered, user-controllable linear actuator with a pneumatic lift spring and position memory raises and lowers the upper frame. The upper frame has three positions: the raised position, ready for a person to use; the lowered position, ready for a person to sit or stand, and collapsed position for storage and transportation. A width adjustment mechanism spreads or contracts the rear ends of the members to best fit any size person.

13 Claims, 4 Drawing Sheets

Related U.S. Application Data filed on Feb. 9, 2015, now abandoned, which is a continuation of application No. 13/839,848, filed on Mar. 15, 2013, now Pat. No. 8,967,642.

(56) References Cited

U.S. PATENT DOCUMENTS 2,738,830 A * 3/1956 Black ..... A61H 3/00 135/67
3,840,034 A * 10/1974 Smith ..... A61H 3/00 135/67
4,019,756 A * 4/1977 Ishida ..... A47D 1/004 280/649
4,123,078 A * 10/1978 Murakami ..... A47D 13/043 280/87.041
4,249,749 A * 2/1981 Collier ..... B62B 1/00 108/145
4,342,465 A * 8/1982 Stillings ..... A61H 3/04 135/67
4,621,804 A * 11/1986 Mueller ..... A47D 13/043 135/67
4,770,410 A * 9/1988 Brown ..... A61H 3/04 135/67
4,799,700 A * 1/1989 Knoedler ..... A47D 13/043 108/120
4,822,030 A * 4/1989 Cone ..... A47C 7/006 280/43.24
5,033,758 A * 7/1991 Levy ..... B62B 3/02 211/201
5,123,665 A * 6/1992 Levy ..... B62B 3/022 211/201
5,217,033 A * 6/1993 Herman, Jr. ..... A61H 3/02 135/68
5,244,443 A * 9/1993 Cerda ..... A47D 15/00 280/87.051
5,366,231 A * 11/1994 Hung ..... A47C 7/006 16/44
5,538,268 A * 7/1996 Miller ..... A61H 3/04 280/87.041
5,727,800 A * 3/1998 Liu ..... A47D 13/043 188/5
5,732,961 A * 3/1998 Theodoropoulos .. A47D 13/043 280/87.051
5,813,720 A * 9/1998 Huang ..... A47D 13/043 280/87.051
6,120,045 A * 9/2000 Rosko ..... A47D 13/043 280/87.021
6,170,840 B1 * 1/2001 Mathias ..... A63B 69/0064 135/69
6,231,056 B1 * 5/2001 Wu ..... A47D 1/02 280/1.188
6,494,815 B1 * 12/2002 Welsh, Jr. ..... A47D 13/043 280/87.051
6,675,820 B2 * 1/2004 Balan ..... A61H 3/008 135/67
6,948,727 B1 * 9/2005 Bakken ..... A61H 3/04 135/67
7,055,847 B2 * 6/2006 Miller ..... B62B 3/022 248/161
7,156,465 B2 * 1/2007 Stewart, III ..... A47C 7/021 297/411.36
7,237,844 B2 * 7/2007 Stewart, III ..... A47C 7/021 297/411.36
8,162,333 B1 * 4/2012 Bartlett ..... A47D 1/004 280/643
8,215,652 B2 * 7/2012 Dashew ..... A61H 3/04 135/67
8,251,380 B2 * 8/2012 Liu ..... A61H 3/04 135/67
8,333,208 B2 * 12/2012 Miller ..... A61H 3/04 135/67
8,646,804 B2 * 2/2014 Derks ..... A61G 5/08 135/67
8,967,642 B2 * 3/2015 Bagheri ..... A61G 5/1002 135/67
9,414,987 B2 * 8/2016 Bagheri ..... A61H 3/008
2007/0163633 A1 * 7/2007 Gale ..... A61H 3/04 135/67
2007/0194547 A1 * 8/2007 Steiner ..... A61G 5/14 280/87.021
2010/0170546 A1 * 7/2010 Popovic ..... A61H 3/008 135/67
2011/0067740 A1 * 3/2011 Menichini ..... A61H 3/04 135/67
2011/0241303 A1 * 10/2011 Campbell ..... A45B 9/02 280/87.041
2011/0260421 A1 * 10/2011 Willis ..... A61H 3/04 280/87.041
2012/0215408 A1 * 8/2012 James ..... B60J 7/165 701/48
2012/0274037 A1 * 11/2012 Miller ..... A61H 3/04 280/87.041
2012/0318587 A1 * 12/2012 Alghazi ..... A61H 3/04 180/6.5
2015/0305963 A1 * 10/2015 Goldman ..... A61H 3/00 135/67
2017/0231855 A1 * 8/2017 Frazier, Jr. ..... A61H 3/008 135/66

* cited by examiner

WALKER

CROSS-REFERENCE TO RELATED APPLICATIONS

This application is a Continuation-in-Part of U.S. patent application Ser. No. 15/712,129, entitled WALKER HARNESS, filed on Sep. 21, 2017, which is a Continuation-in-Part of U.S. patent application Ser. No. 15/218,052, entitled WALKER, filed on Jul. 24, 2016, which is a continuation of U.S. application Ser. No. 15/013,000 filed Feb. 2, 2016, entitled WALKER, now U.S. Pat. No. 9,414,987, which is a continuation-in-part of U.S. application Ser. No. 14/617,872 filed Feb. 9, 2015, entitled WALKER, which is a continuation of U.S. application Ser. No. 13/839,848 filed Mar. 15, 2013, entitled WALKER, now U.S. Pat. No. 8,967,642, all of which are incorporated in their entirety herein by reference.

STATEMENT REGARDING FEDERALLY SPONSORED RESEARCH AND DEVELOPMENT

Not Applicable.

FIELD OF THE INVENTION

This invention relates to assistive devices, and more particularly to a walker with a U-shaped lower frame, a plurality of wheels fixed with the U-shaped lower frame, a U-shaped upper frame, generally vertical left and right double scissor mechanisms interposed between the U-shaped lower frame and the U-shaped upper frame that hold the U-shaped lower frame in alignment with the U-shaped upper frame, and a linear actuator; and where the walker is adapted to provide motorized height adjustment capability, increased independence and range of activity, increased safety when sitting or standing (especially for persons with subnormal leg muscle strength or balance difficulties), and a minimized storage and transportation footprint.

BACKGROUND

This invention relates to assistive devices, and more particularly to a walker with a U-shaped lower frame, a plurality of wheels fixed with the U-shaped lower frame, a U-shaped upper frame, generally vertical left and right double scissor mechanisms interposed between the U-shaped lower frame and the U-shaped upper frame that hold the U-shaped lower frame in alignment with the U-shaped upper frame, and a linear actuator; and where the walker is adapted to provide motorized height adjustment capability, increased independence and range of activity, increased safety when sitting or standing (especially for persons with subnormal leg muscle strength or balance difficulties), and a minimized storage and transportation footprint. The prior art includes: U.S. Pat. No. 2,020,766A (Nov. 12, 1935); U.S. Pat. No. 2,645,538A (Jul. 14, 1953); U.S. Pat. No. 2,738,830A (Mar. 20, 1956); U.S. Pat. No. 3,840,034A (Oct. 8, 1974); U.S. Pat. No. 4,019,756A (Apr. 26, 1977); U.S. Pat. No. 4,123,078A (Oct. 31, 1978); U.S. Pat. No. 4,249,749A (Feb. 10, 1981); U.S. Pat. No. 4,342,465A (Aug. 3, 1982); U.S. Pat. No. 4,621,804A (Nov. 11, 1986); U.S. Pat. No. 4,770,410A (Sep. 13, 1988); U.S. Pat. No. 4,799,700A (Jan. 24, 1989); U.S. Pat. No. 4,822,030A (Apr. 18, 1989); U.S. Pat. No. 5,033,758A (Jul. 23, 1991); U.S. Pat. No. 5,123,665A (Jun. 23, 1992); U.S. Pat. No. 5,217,033A (Jun. 8, 1993); U.S. Pat. No. 5,244,443A (Sep. 14, 1993); U.S. Pat. No. 5,366,231A (Nov. 22, 1994); U.S. Pat. No. 5,538,268A (Jul. 23, 1996); U.S. Pat. No. 5,727,800A (Mar. 17, 1998); U.S. Pat. No. 5,732,961A (Mar. 31, 1998); U.S. Pat. No. 5,813,720A (Sep. 29, 1998); U.S. Pat. No. 6,120,045A (Sep. 19, 2000); U.S. Pat. No. 6,170,840B1 (Jan. 9, 2001); U.S. Pat. No. 6,231,056B1 (May 15, 2001); U.S. Pat. No. 6,494,815B1 (Dec. 17, 2002); U.S. Pat. No. 6,675,820B2 (Jan. 13, 2004); U.S. Pat. No. 6,948,727B1 (Sep. 27, 2005); U.S. Pat. No. 7,055,847B2 (Jun. 6, 2006); U.S. Pat. No. 7,156,465B2 (Jan. 2, 2007); U.S. Pat. No. 7,237,844B2 (Jul. 3, 2007); U.S. Patent Application No. 2007/0163633A1 (Jul. 19, 2007); U.S. Patent Application No. 2010/0170546A1 (Jul. 8, 2010); U.S. Patent Application No. 2011/0067740A1 (Mar. 24, 2011); U.S. Patent Application No. US 2011/0241303A1 (Oct. 6, 2011); U.S. Patent Application No. 2011/0260421A1 (Oct. 27, 2011); U.S. Pat. No. 8,162,333B1 (Apr. 24, 2012); U.S. Pat. No. 8,215,652B2 (Jul. 10, 2012); U.S. Patent Application No. 2012/0215408A1 (Aug. 23, 2012); U.S. Pat. No. 8,251,380B2 (Aug. 28, 2012); U.S. Patent Application No. 2012/0274037A1 (Nov. 1, 2012); U.S. Pat. No. 8,333,208B2 (Dec. 18, 2012); U.S. Patent Application No. 2012/0318587A1 (Dec. 20, 2012); U.S. Pat. No. 8,562,007B2 (Oct. 22, 2013); U.S. Pat. No. 8,646,804B2 (Feb. 11, 2014). It is desirable to have an improved cart that is superior to any that is disclosed or suggested in the identified references.

SUMMARY

The present device is a walker for use by a person to assist in standing and ambulation upon a horizontal surface. The walker comprises a U-shaped lower frame and a U-shaped upper frame. The lower frame comprises a left lower member and a right lower member. The left lower member and the right lower member are mutually connected at a front end of the left lower member and a front end of the right lower member by a front lower connector. The lower frame is oriented in a horizontal position and includes a plurality of wheels fixed with the lower frame and configured for rollingly supporting the walker on the horizontal surface. In some preferred embodiments, the wheels are pivotable casters.

In some other preferred embodiments, at least two of the wheels are fixed to the lower frame with a foot extension pivotally attached at a proximate side thereof to the lower frame. Such embodiments also include a foot spring proximate the foot extension configured for urging the foot extension outwardly from the lower frame to further stabilize the walker. When entering a narrow walkway, each of the foot extensions can be pivoted inwardly so that the walker clears the walkway. After the walker clears the walkway, the foot extensions automatically return to their original positions.

The upper frame comprises a left upper member and a right upper member. In some preferred embodiments, the left upper member and the right upper member each include an upwardly-facing member cushion for resting arms of the person thereon. The left upper member and the right upper member are mutually connected at a front end of the left upper member and a front end of the right upper member by a front upper connector and a rear upper connector. The upper frame is oriented in a horizontal position generally above the lower frame. Thus, the left upper member is generally above the left lower member, the right upper member is generally above the right lower member, and the lower frame and the upper frame are configured to surround the person on three sides.

The walker further comprises a generally vertical left double scissor mechanism interposed between the left lower member and the left upper member; a generally vertical right double scissor mechanism interposed between the right lower member and the right upper member; and at least one linear actuator pivotally fixed between each of the rear upper connector and the front lower connector. When the at least one linear actuator moves towards a fully extended position, the upper frame moves towards a fully raised position. When the at least one linear actuator moves towards a fully retracted position the upper frame moves towards a fully lowered position. During such movement, the upper frame remains held in alignment with the lower frame by the left double scissor mechanism and the right double scissor mechanism. In some preferred embodiments, the left double scissor mechanism and the right double scissor mechanism each include at a top end thereof an upper fixed member and an upper sliding member. Each upper sliding member is slidably captured in a downwardly-facing track formed in each of the left upper member and the right upper member of the upper frame. Likewise, in such embodiments, both the left double scissor mechanism and the right double scissor mechanism include at a bottom end thereof a lower fixed member and a lower sliding member. Each of the lower sliding members is slidably captured in an upwardly-facing track formed in the left lower member and the right lower member of the lower frame.

In some preferred embodiments, the at least one linear actuator is motor-driven and operatively connected with a power source and a user control disposed proximate the rear upper connector. The user control is configured for extending, retracting, or stopping the at least one linear actuator. More preferably, the power source is a rechargeable battery pack, and the user control includes at least one linear actuator position memory setting configured to return the at least one linear actuator to a position stored in a memory of the user control. Also more preferably, each of the at least one linear actuators includes a pneumatic lift spring configured to urge the upper frame upwards away from the lower frame, but that may be retracted under the force of the linear actuator and/or the weight of the person.

In some preferred embodiments, the rear upper connector is selectively positionable between a forward position and a rearward position within two opposing connector slots. One of the connector slots is formed in the left upper member, and one of the connector slots is formed in the right upper member. When the rear upper connector is in the forward position and with the at least one linear actuator in the fully retracted position, the walker is in a fully lowered position, with the upper frame and the lower frame a first distance apart. When the rear upper connector is in the rearward position and with the at least one linear actuator in the fully retracted position, the walker is in a fully collapsed position, with the upper frame and the lower frame a second distance apart. The second distance is less than the first distance.

In some preferred embodiments, the left lower member and the right lower member are each connected via pivots with the front lower connector, and the left upper member and the right upper member are each connected via pivots with the front upper connector. In such preferred embodiments, the rear upper connector includes a width adjustment mechanism for adjusting the length of the rear upper connector between a minimum length and a maximum length. To accommodate larger persons, rear ends of the left lower member, the right lower member, the left upper member and the right upper member are moved apart from each other by lengthening the rear upper connector.

Various support extension can be mounted to the upper frame in order to cater to needs of users based on their specific disability, strength, size, etc. This can be in the form of one or both sides having supports similar to crutches that fit under the user's arm to provide more support on one or both sides.

The present invention is a walker with U-shaped upper and lower frames, a plurality of wheels fixed with the lower frame, and generally vertical left and right double scissor mechanisms interposed between the lower and upper frames. The scissor mechanisms hold the frames in alignment with each other. The walker provides motorized height adjustment capability and grants a person increased independence and range of activity, as well as increased safety when sitting or standing. The latter is especially a benefit for persons with subnormal leg muscle strength or balance difficulties. Because the walker is fully collapsible, it also features a minimized storage and transportation footprint that makes the work of anyone assisting a disabled person far easier and less physically strenuous, which itself can help avoid potential injuries typically associated with moving large pieces of durable medical equipment.

It is important to minimize fatigue for persons using the walker—because of either temporary or permanent disability, the very act of moving is likely to take more effort in any case than would be necessary for a fully able-bodied person. An ideal walker should thus not be overly burdensome. For this reason, the walker is constructed using round carbon fiber tubing in its construction to achieve a superior balance between high structural integrity and low weight, enabling a stronger, lighter structure than many contemporary alternatives. This material and shaping is particularly advantageous over a combination of square tubing and carbon rods. Any material with similar mechanical properties may also be used for similar benefit. Due to the use of such materials, as well as improvements to the connectors, lift system, and battery system, the overall weight of the present invention has decreased approximately forty percent from the applicant's disclosure in U.S. patent application Ser. No. 15/218,052.

The three-piece scissor mechanism—generally a single large tube wedged in between two smaller tubes—provides a number of advantages over contemporary devices, as well. The mechanism itself is designed to optimize the walker's structural stability when in use—in comparison to other contemporary products. It is also mechanically simpler than other contemporary products using scissor mechanisms with more than three pieces, which increases robustness while decreasing the likelihood of mechanical failure with normal use. Likewise, the combination aluminum and carbon fiber pieces used to attach the various connection points to each other throughout the invention, as well as systematically ensuring such connections are as tight as possible, further increases structural integrity.

To increase durability and overall service lifetime, the invention uses a wheeled wedge or a low-friction cylinder, such as made with Delrin®-type Polyoxymethylene or similar materials, inside the round tubing. This reduces internal friction losses as the wedge goes back and forth in the track system when the invention's height is lowered or raised. Less friction leads to less wear, thus maximizing both the invention's service time between necessary maintenance and repair and also its overall operational lifetime.

Lift occurs as a result the front scissor legs of each scissor mechanism moving in their respective tracks, anchored by the back scissor legs of each scissor mechanism which are fixed with the upper and lower frames. To go from the storage or fully-collapsed position to the fully-lowered position (or a seat/bed height position), the back scissor legs move from the back of the connector slots or tracks to the front of the connector slots where they lock into place. Once at this height then the front scissor legs move back inside their tracks in order to lift the top frame from the seat/bed height to the standing height fully-raised position. In case of lifting a patient from the sitting to standing position only the second portion of this lift is required to be automated, that is, from the fully-lowered to fully-raised positions. In case of lifting a quadriplegic patient laying on the bed or ground, for example, both lift functions (from fully-retracted to fully-lowered, and then from fully-lowered to fully-raised) are motorized or automated since even the first part of this lifting process is weight bearing.

The design gives particular attention to reducing sway while the invention is in use. The invention disclosed herein has been engineered to have superior structural integrity and stability, and in particular less instability and sway than the disclosure in the applicant's previous U.S. patent application Ser. No. 15/218,052. This is accomplished herein first by fixing a telescoping connector between the left and right members of the upper frame. In addition to enhancing structural integrity, the connector expands and contracts as needed to allow the invention to expand and contract laterally, thus optimally accommodating persons of varying girths. Secondly, further connections exist between the left and right members of the lower frame as illustrated herein, creating in total at least four points of connection to the lower frame and at least two points in the upper frame. All of these enhance the invention's lateral structural stability and integrity, which both increases safety for the person using the walker and provides a premium user experience.

The invention is also designed to ensure proper expansion and contraction during height adjustment to avoid any asymmetrical vertical alignment of the left and right members of the upper frame, which would render the walker unfit and unsafe for normal use. To guarantee symmetrical vertical alignment during height adjustment, the left and right members of the lower frame are attached to a rack and pinion system mounted at the rear of the invention. This configuration does not interfere with ambulation but maintains symmetrical horizontal alignment and also provides sufficient strength to keep the walker from inadvertently opening or closing when bearing a person's weight.

Flexibility in use has not been sacrificed in the name of structural integrity and stability. The invention is generally suitable for all terrains. In addition, when the invention is configured with the pivotable caster and foot spring assembly, the walker is able to reduce its effective girth when traversing a narrow walkway by narrowing the horizontal distance between the casters on the left and right lower members. Once the obstruction has been cleared, each caster automatically returns to its normal position. This is of particular benefit for walkers configured for use by larger children and adults. Many contemporary competing assistive devices configured for such use do not include any features to assist in traversing narrow walkways. This often results in additional difficulty in movement for the disabled person. It also risks damage to both the assistive device and the narrow opening, either of which may be difficult or costly to repair.

Notably, no prior or contemporary devices automate the process lifting a person from the ground to a sitting position, and from there a standing position. Nor do any prior or contemporary devices allow a quadriplegic to go from a prone position to a sitting position. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. Finally, "Detailed Description" refers to this Detailed Description of the Preferred Embodiment.

Figure 1:
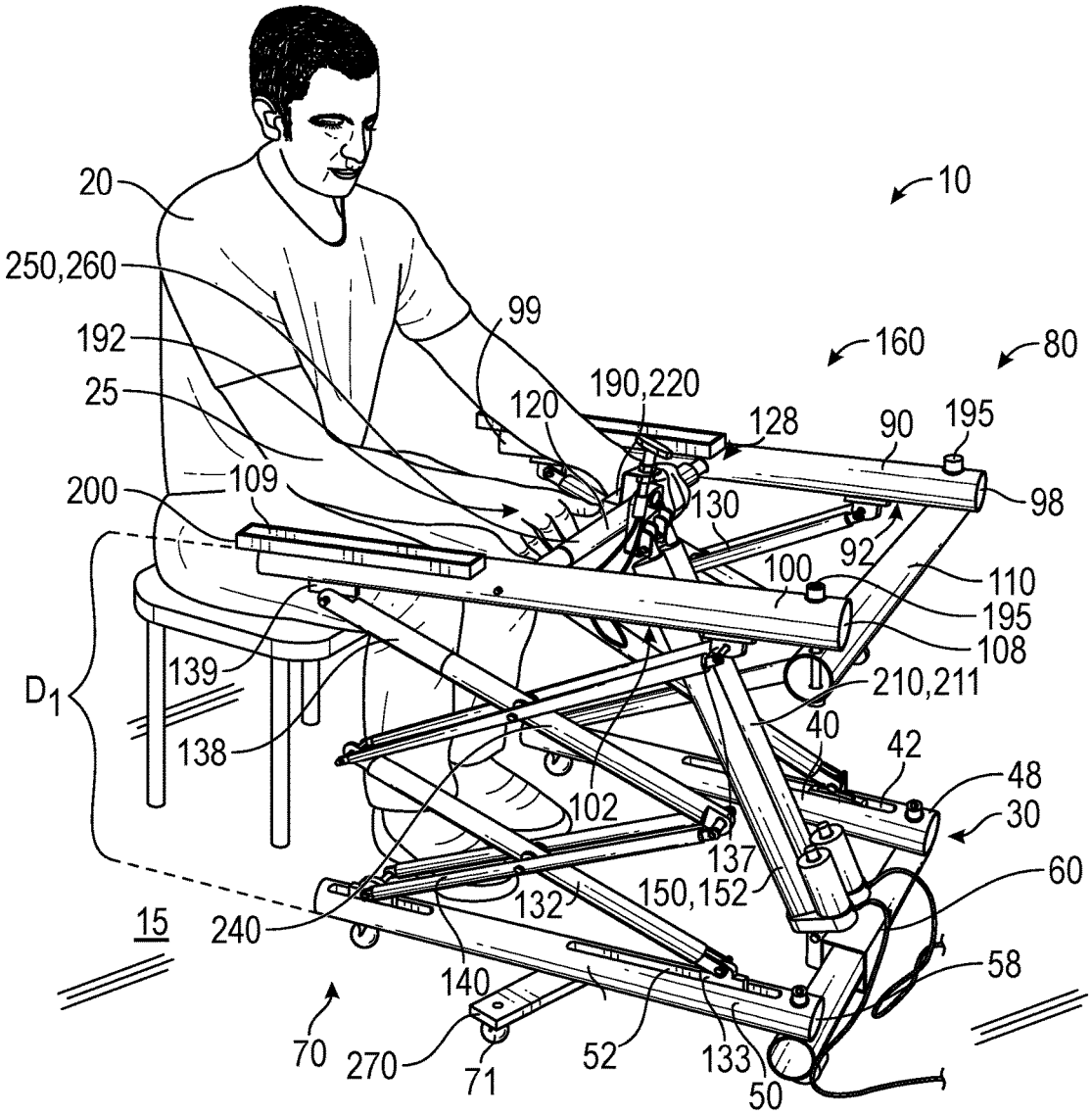
FIG. 1 is a front perspective view of one embodiment of the invention, shown in use by a person with the upper frame in a fully lowered position.
Figure 2:
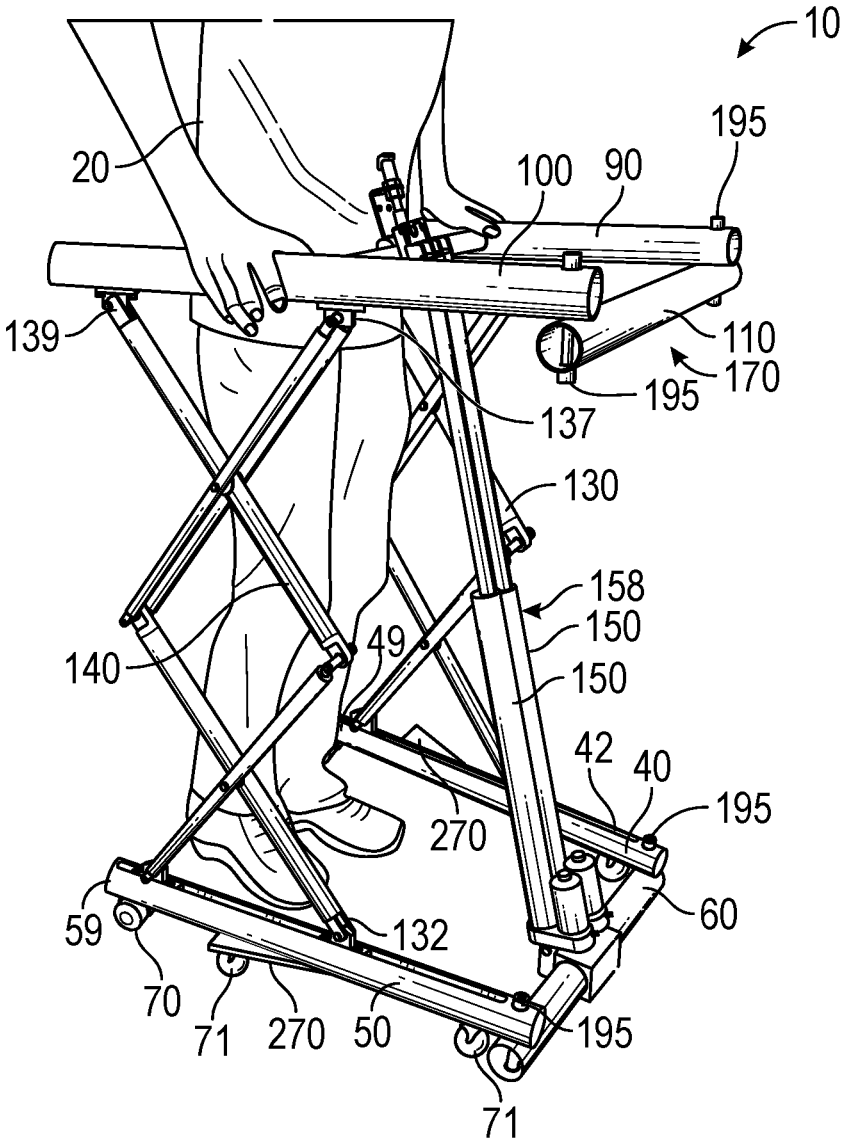
FIG. 2 is a front perspective view of one embodiment of the invention, shown in use by a person with the upper frame in a fully raised position.
Figure 3:
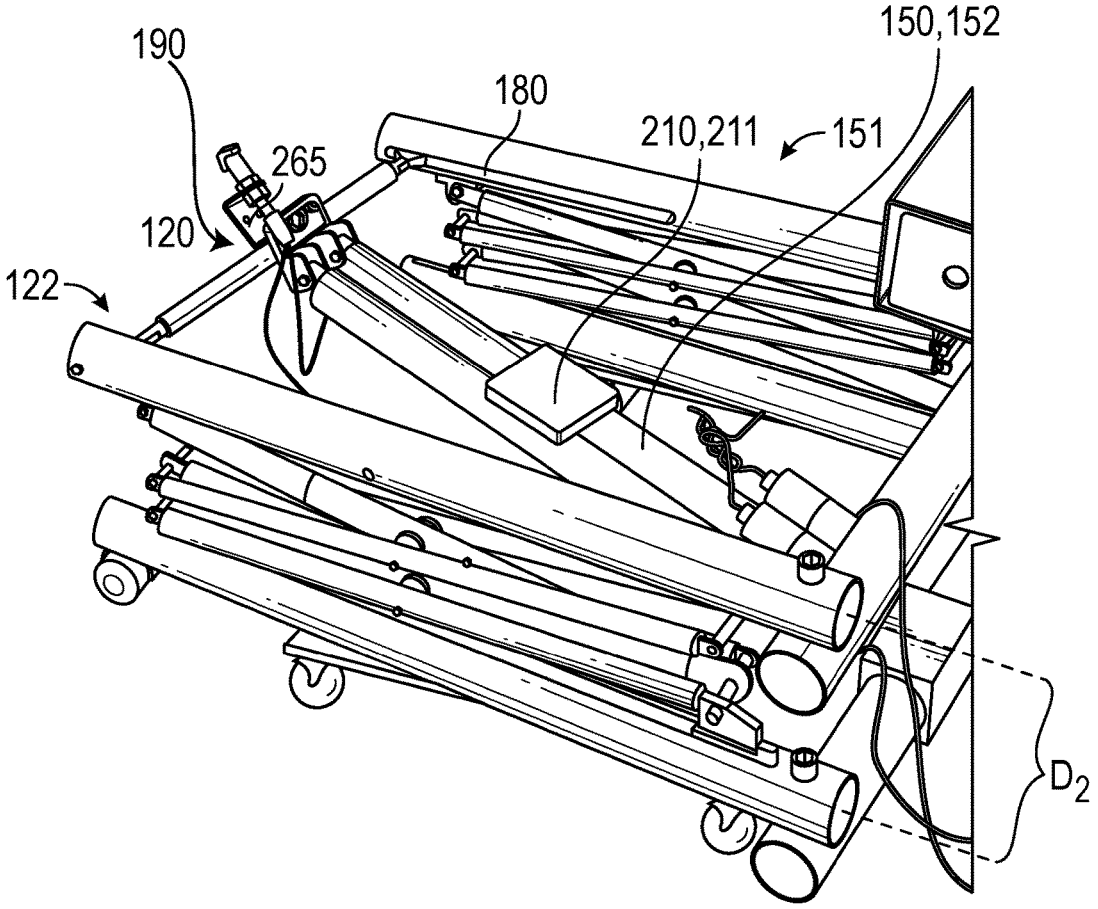
FIG. 3 is a side perspective view of one embodiment of the invention, shown in a fully collapsed position.
Figure 4:
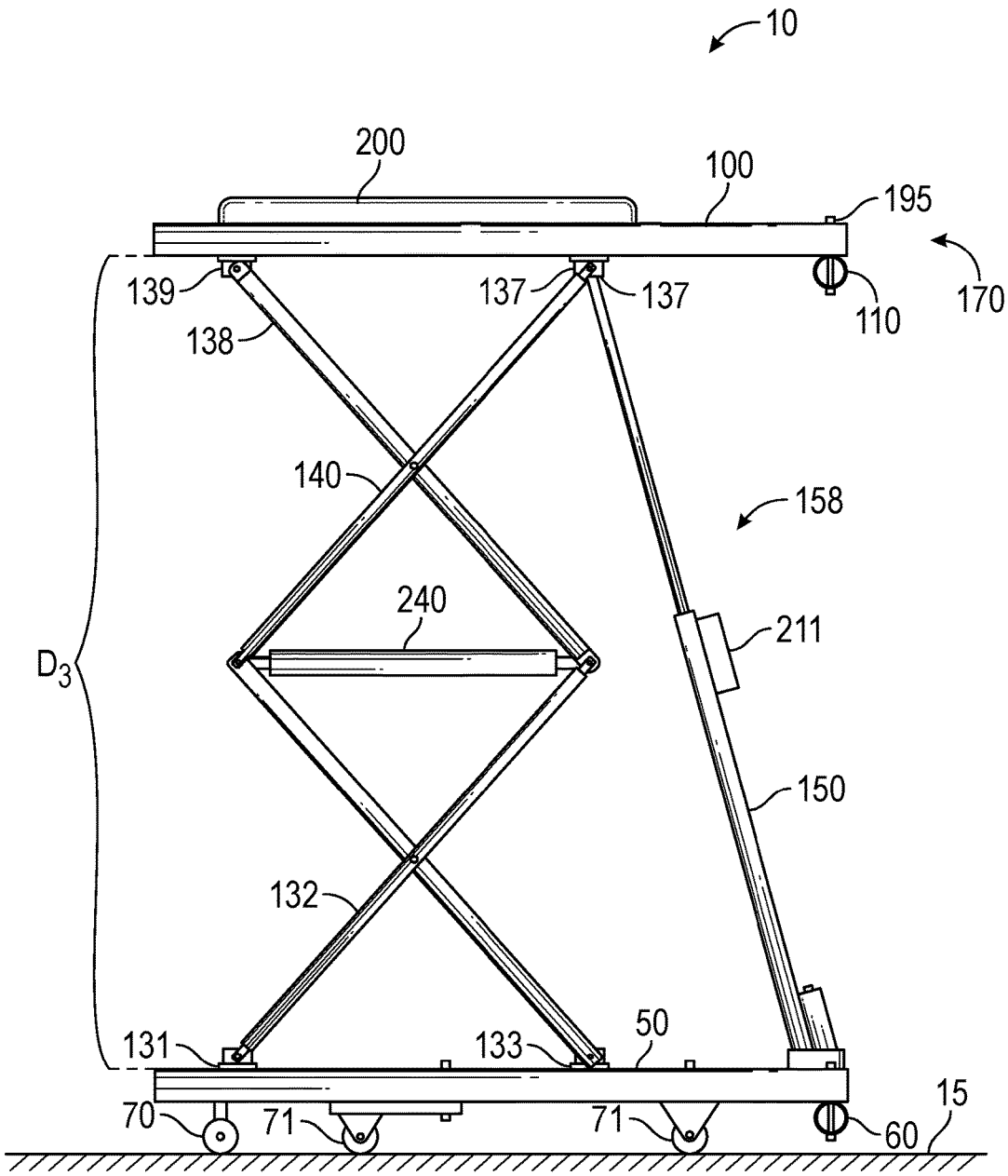
FIG. 4 is a side perspective view of one embodiment of the invention, shown in the fully-raised position.

FIGS. 1-4 illustrate a walker 10 (FIGS. 1-2, 4) for use by a person 20 (FIGS. 1-2) to assist in standing and ambulation upon a horizontal surface 15 (FIGS. 1, 4). The walker 10 comprises a U-shaped lower frame 30 (FIG. 1) and a U-shaped upper frame 80 (FIG. 1). The lower frame 30 comprises a left lower member 40 (FIGS. 1-2) and a right lower member 50 (FIGS. 1-2, 4). The left lower member 40 and the right lower member 50 are mutually connected at a front end 48 (FIG. 1) of the left lower member 40 and a front end 58 (FIG. 1) of the right lower member 50 by a front lower connector 60 (FIGS. 1-2, 4). The lower frame 30 is oriented in a horizontal position $P_1$ (FIG. 4) and includes a plurality of wheels 70 (FIGS. 1-2, 4) fixed with the lower frame 30 and configured for rollingly supporting the walker on the horizontal surface 15. In some preferred embodiments, at least two of the rear-most wheels 70 of the lower frame are non-pivoting, and at least two of the forward-most wheels are pivotable casters 71 (FIGS. 1-2, 4). Alternately, all of the wheels 70 may be casters 71.

In some other preferred embodiments, at least two of the wheels 70 are fixed to the lower frame 30 with a foot extension 270 (FIGS. 1-2) pivotally attached at a proximate side 271 (FIG. 2) thereof to the lower frame 30. Such embodiments also include a foot spring 275 (FIG. 2) proximate the foot extension 270 configured for urging the foot extension 270 outwardly from the lower frame 30 to further stabilize the walker 10. When entering a narrow walkway (not shown), each of the foot extensions 270 can be pivoted inwardly so that the walker 10 clears the walkway 17. After the walker 10 clears the walkway 17, the foot extensions 270 automatically return to their original positions to provide a wider base for greater stability.

The upper frame 80 comprises a left upper member 90 (FIGS. 1-2) and a right upper member 100 (FIGS. 1-2, 4). In some preferred embodiments, the left upper member 90 and the right upper member 100 each include an upwardly-facing member cushion 200 (FIGS. 1, 4) for resting arms 25 (FIG. 1) of the person 20 thereon. The left upper member 90 and the right upper member 100 are mutually connected at a front end 98 (FIG. 1) of the left upper member 90 and a front end 108 (FIG. 1) of the right upper member 100 by a front upper connector 110 (FIGS. 1-2, 4) and a rear upper connector 120 (FIGS. 1, 3).

The upper frame 80 is oriented in a horizontal position $P_2$ (FIG. 4) generally above the lower frame 30. Thus, the left upper member 90 is generally above the left lower member 40, the right upper member 100 is generally above the right lower member 50, and the lower frame 30 and the upper frame 80 are configured to surround the person 20 on three sides.

The walker 10 further comprises a generally vertical left double scissor mechanism 130 (FIGS. 1-2) interposed between the left lower member 40 and the left upper member 90; a generally vertical right double scissor mechanism 140 (FIGS. 1-2, 4) interposed between the right lower member 50 and the right upper member 100; and at least one linear actuator 150 (FIGS. 1-4) pivotally fixed between each of the rear upper connector 120 and the front lower connector 60. When the at least one linear actuator 150 moves towards a fully extended position 158 (FIGS. 2, 4), the upper frame 80 moves towards a fully-raised position 170 (FIGS. 2, 4). When the at least one linear actuator 150 moves towards a fully retracted position 152 (FIGS. 1, 3) the upper frame 80 moves towards a fully lowered position 160 (FIG. 1). During such movement, the upper frame 80 remains held in alignment with the lower frame 30 by the left double scissor mechanism 130 and the right double scissor mechanism 140. In some preferred embodiments, the left double scissor mechanism 130 and the right double scissor mechanism 140 each include at a top end 138 (FIG. 4) thereof an upper fixed member 139 (FIGS. 1-2, 4) and an upper sliding member 137 (FIGS. 1-2, 4). Each upper sliding member 137 is slidably captured in a downwardly-facing track 92, 102 (FIG. 1) formed in each of the left upper member 90 and the right upper member 100 of the upper frame 80. Likewise, in such embodiments, both the left double scissor mechanism 130 and the right double scissor mechanism 140 include at a bottom end 132 (FIGS. 1, 4) thereof a lower fixed member 131 (FIGS. 1, 4) and a lower sliding member 133 (FIGS. 1, 4). Each of the lower sliding members 133 is slidably captured in an upwardly-facing track 42 (FIGS. 1-2) and 52 (FIG. 1) formed in the left lower member 40 and the right lower member 50 of the lower frame 30, respectively. The upward-facing tracks 42, 52 are essentially mirror images of the downwardly-facing tracks 92, 102.

In some preferred embodiments, the at least one linear actuator 150 is motor-driven and operatively connected with a power source 210 (FIGS. 1, 3) and a user control 220 (FIG. 1) disposed proximate the rear upper connector 120. The user control 220 is configured for extending, retracting, or stopping the at least one linear actuator 150. More preferably, the power source 210 is a rechargeable battery pack 211 (FIGS. 1, 3-4), and the user control 220 includes at least one linear actuator position memory setting 230 (FIG. 1) configured to return the at least one linear actuator 150 to a position stored in a memory 235 (FIG. 1) of the user control 220. Also more preferably, each of the at least one linear actuators 150 includes a pneumatic lift spring 240 (FIGS. 1, 4) configured to urge the upper frame 80 upwards away from the lower frame 30, but that may be retracted under the force of the linear actuator 150 and/or the weight of the person 20.

In some preferred embodiments, the rear upper connector 120 is selectively positionable between a forward position 128 (FIG. 1) and a rearward position 122 (FIG. 3) within two opposing connector slots 180 (FIG. 3). One of the connector slots 180 is formed in the left upper member 90, and one of the connector slots 180 is formed in the right upper member 100. When the rear upper connector 120 is in the forward position 128 and with the at least one linear actuator 150 in the fully retracted position 152, the walker 10 is in a fully-lowered position 160 (FIG. 1), with the upper frame 80 and the lower frame 30 a first distance $D_1$ (FIG. 1) apart. When the rear upper connector 120 is in the rearward position 122 and with the at least one linear actuator 150 in the fully retracted position 152, the walker 10 is in a fully collapsed position 151 (FIG. 3), with the upper frame 80 and the lower frame 30 a second distance $D_2$ (FIG. 3) apart. The second distance $D_2$ is less than the first distance $D_1$. Preferably the walker 10 is no higher than about 19 inches when in the full-lowered position 160, and no higher than about 9 inches when in the fully-retracted position 152.

In some preferred embodiments, the left lower member 40 and the right lower member 50 are each connected via pivots 195 (FIGS. 1-2) with the front lower connector 60, and the left upper member 90 and the right upper member 100 are each connected via pivots 195 with the front upper connector 110. In such preferred embodiments, the rear upper connector 120 includes a width adjustment mechanism 190 (FIG. 1) for adjusting the length of the rear upper connector 120 between a minimum length 192 (FIG. 1) and a maximum length (not shown). Optionally, the width adjustment mechanism 190 may be a manually adjustable rack-and-pinion mechanism 250 (FIG. 1). Alternatively, the width adjustment mechanism 190 may be a motor-driven mechanism 260 (FIG. 1) operatively connected with a power source 261 (FIG. 1) and a user control 265 (FIG. 1) disposed proximate the rear upper connector 120. In such a configuration, the user control 265 is configured for extending, retracting, or stopping the width adjustment mechanism 190. To accommodate larger persons 20, rear ends 49 (FIG. 2), 59 (FIG. 1), 99 (FIG. 1), and 109 (FIG. 1) of the left lower member 40, the right lower member 50, the left upper member 90, and the right upper member 100, respectively, are moved apart from each other by lengthening the rear upper connector 120. Moreover, when the rear upper connector 120 is set to its minimum length 192, the walker 10 is able to clear narrow doorways and passageways more easily.

The lower frame 30, the upper frame 80, the left double scissor mechanism 130, and the right double scissor mechanism 140 may be made from round carbon fiber tubing. Any other material with substantially similar mechanical characteristics and weight to round carbon fiber tubing, or combination of such materials, that is suitable for use in long-term durable medical equipment may also be used for the lower frame 30, the upper frame 80, the left double scissor mechanism 130, and the right double scissor mechanism 140. The front lower connector 60, the front upper connector 110, and rear upper connector 120 may utilize applicable off-the-shelf carbon fiber and aluminum connector products distributed by DragonPlate™, or any other manufactured product or custom solution with similar mechanical characteristics that is suitable for use in long-term durable medical equipment. The width adjustment mechanism 190 may be built around the rear upper connector 120 manufactured from a two-piece telescoping carbon fiber tube, or from any other material with substantially similar mechanical characteristics, or combination of such materials, that is suitable for use in long-term durable medical equipment.

While a particular form of the invention has been illustrated and described, it will be apparent that various modifications can be made without departing from the spirit and scope of the invention. For example, multiple variations of the cushion 200 may be used, including but not limited to those made from Plastazote® or another high-density foam, and those covered in leather, vinyl, or neoprene, and the like, or any other sufficiently durable material mechanically suitable for long-term use on an assistive device such as the walker 10. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above Detailed Description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Any element in a claim that does not explicitly state "means for" performing a specified function or "step for" performing a specified function is not to be interpreted as a "means" or "step" clause as specified in 35 U.S.C. § 112(f). In particular, any use of "step of" in the claims herein is not intended to invoke the provisions of 35 U.S.C. § 112(f).

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A walker for use by a person on a horizontal surface, comprising:

a U-shaped lower frame comprising a left lower member and a right lower member mutually connected at front ends thereof by a front lower connector, the lower frame oriented in a horizontal position;

a plurality of wheels fixed with the lower frame and configured for rollingly supporting the walker on the horizontal surface;

a U-shaped upper frame comprising a left upper member and a right upper member mutually connected at front ends thereof by a front upper connector and a rear upper connector, the upper frame oriented in a horizontal position generally above the lower frame, whereby the left upper member is generally above the left lower member and the right upper member is generally above the right lower member, and wherein the lower frame and upper frame are configured to surround a person on three sides;

a generally vertical left double scissor mechanism interposed between the left lower member and the left upper member;

a generally vertical right double scissor mechanism interposed between the right lower member and the right upper member;

at least one linear actuator pivotally fixed between each of the rear upper connector and the front lower connector;

whereby when the at least one linear actuator moves towards a fully-extended position the upper frame moves towards a fully-raised position, and when the at least one linear actuator moves towards a fully-retracted position the upper frame moves towards a fully-lowered position, the upper frame aligned with the lower frame by the left and right double scissor mechanisms.

2. The walker of claim 1 wherein the rear upper connector is selectively positionable between a forward position and a rearward position within two opposing connector slots formed in the left and right upper members;

whereby when the rear upper connector is in the forward position and with the at least one linear actuator in the fully-retracted position, the walker is in a fully-lowered position with the upper and lower U-shaped frames a first distance apart;

and whereby when the rear upper connector is in the rearward position and with the at least one linear actuator in the fully-retracted position, the walker is in a fully collapsed position with the upper frame and the lower frame a second distance apart less than the first distance.

3. The walker of claim 1 wherein the left lower member and the right lower member are each connected via pivots with the front lower connector, the left upper member and the right upper member are each connected via pivots with the front upper connector, and the rear upper connector includes a width adjustment mechanism for adjusting the length of the rear upper connector between a minimum length and a maximum length, whereby to accommodate larger persons, rear ends of the left lower member, the right lower member, the left upper member and the right upper member are moved apart from each other by lengthening the rear upper connector.

4. The walker of claim 1 wherein the left upper member and the right upper member each include an upwardly-facing member cushion for resting arms of the person thereon.

5. The walker of claim 1 wherein the wheels are pivotable casters.

6. The walker of claim 1 wherein the at least one linear actuator is motor-driven and operatively connected with a power source and a user control disposed proximate the rear upper connector, the user control configured for extending, retracting, or stopping the at least one linear actuator.

7. The walker of claim 6 wherein the power source is a rechargeable battery pack.

8. The walker of claim 6 wherein the user control includes at least one linear actuator position memory setting configured to return the at least one linear actuator to a position stored in a memory of the user control.

9. The walker of claim 6 wherein each of the at least one linear actuator includes a pneumatic lift spring configured to urge the upper frame upwards away from the lower frame, but that may be retracted under the force of the linear actuator and/or the weight of the person.

10. The walker of claim 1 wherein the left double scissor mechanism and the right double scissor mechanism each include at a top end thereof an upper fixed member and an upper sliding member, the upper sliding member slidably captured in a downwardly-facing track formed in each of the left upper member and the right upper member of the upper frame, and likewise both the left double scissor mechanism and the right double scissor mechanism include at a bottom end thereof a lower fixed member and a lower sliding member, each of the lower sliding members slidably captured in an upwardly-facing track formed in the left lower member and the right lower member of the lower frame.

11. The walker of claim 3 wherein the width adjustment mechanism is a manually adjustable rack-and-pinion mechanism.

12. The walker of claim 3 wherein the width adjustment mechanism is a motor-driven mechanism operatively connected with a power source and a user control disposed proximate the rear upper connector, the user control configured for extending, retracting, or stopping the width adjustment mechanism.

13. The walker of claim 1 wherein at least two of the wheels are fixed to the lower frame with a foot extension pivotally attached at a proximate side thereof to the lower frame, and a foot spring proximate the foot extension configured for urging the foot extension outwardly from the lower frame to further stabilize the walker, whereupon entering a narrow walkway each of the foot extensions can be pivoted inwardly so that the walker clears the walkway.

* * * * *